US006019181A

United States Patent [19]

Soinski et al.

[11] Patent Number: 6,019,181

[45] Date of Patent: Feb. 1, 2000

[54] CORE DRILLING LATCH ASSEMBLY

[75] Inventors: Frederick J. Soinski, Fruita; Donald Raymond, Loma, both of Colo.

[73] Assignee: Northwest Machine Works, Inc., Grand Junction, Colo.

[21] Appl. No.: 09/339,551

[22] Filed: Jun. 24, 1999

Related U.S. Application Data

[63] Continuation of application No. 09/144,239, Aug. 31, 1998, and a continuation of application No. 08/734,977, Oct. 22, 1996, Pat. No. 5,799,742.

[51] Int. Cl.[7] ..... E21B 49/00

[52] U.S. Cl. ..... 175/58; 175/234; 175/236; 175/247

[58] Field of Search ..... 175/58, 234, 236, 175/244, 246, 247

[56] References Cited

U.S. PATENT DOCUMENTS

| | | | |
|---|---|---|---|
| 3,225,845 | 12/1965 | Koontz et al. . | |
| 3,777,826 | 12/1973 | Wolda . | |
| 3,952,816 | 4/1976 | Takano et al. | 175/107 X |
| 3,977,482 | 8/1976 | Reed et al. | 175/246 |
| 3,986,555 | 10/1976 | Robertson . | |
| 3,990,524 | 11/1976 | Sweeney . | |
| 4,466,497 | 8/1984 | Soinski et al. . | |
| 4,800,969 | 1/1989 | Thompson . | |
| 5,020,612 | 6/1991 | Williams . | |
| 5,267,620 | 12/1993 | Lee . | |
| 5,325,930 | 7/1994 | Harrison . | |
| 5,339,915 | 8/1994 | Laporte et al. . | |
| 5,799,742 | 9/1998 | Soinski et al. . | |

FOREIGN PATENT DOCUMENTS

| | | |
|---|---|---|
| 1148390 | 1/1987 | U.S.S.R. . |

*Primary Examiner*—Roger Schoeppel

[57] ABSTRACT

A core drilling latch assembly for use in terrestrial core drilling operations. The latch assembly incorporates features and elements which affect the flow of drilling fluids past the latch assembly and toward the drill bit, depending upon whether the latch assembly has contacted the landing ring in the drill string and whether the latch assembly has locked in place within the string. Accordingly, the latch assembly signals the drilling crew by pressure fluctuations when the latch assembly is in proper position within the drill string, and whether it is locked in position.

3 Claims, 3 Drawing Sheets

CORE DRILLING LATCH ASSEMBLY

This is a continuation of application Ser. No. 09/144,239 filed Aug. 31, 1998 and a continuation of application Ser. No, 08/734,988 filed Oct. 22, 1996 now U.S. Pat. No. 5,799,742.

FIELD OF THE INVENTION

The invention relates to an apparatus for terrestrial core drilling, and more particularly to a core barrel latch assembly including apparatuses for confirming when the assembly is properly latched within the drill string.

BACKGROUND OF THE INVENTION

Operations to drill into the earth's crust, such as to explore for and/or to extract petroleum and the like, usually employ lengthy rotary drill strings. A drill string typically includes a series of interconnected pipes with a drill bit disposed upon one end. The drill string usually is substantially vertically oriented, or frequently is angled to drill an inclined hole, with drilling progressing downward into the earth from the ground's surface. Instances where drilling is generally downward, in concert with the forces of gravity, commonly are referred to as "down hole" operations. Improved technologies and continuing demand for petroleum and other subsurface mineral resources have made it possible also to economically engage in "up hole" drilling. In up hole operations, drilling commences upon a mountainside and proceeds upward against the force of gravity, with the drill string inclined, permitting the hole to be cut at an upward angle.

As drilling progresses, a cylindrical subsurface core sample is produced and may be retained in an inner tube or "core barrel" disposed coaxially within the hollow drill string interior. An important aspect of core drilling is the periodic retrieval of the core sample from the hole for analysis. Retrieval of the sample is performed using a variety of core barrel assemblies. A succinct and helpful background explanation of core drilling and core sample retrieval processes may be had by reference to U.S. Pat. No. 4,466,497 to Soinski, et al. The present invention, while adaptable for use in other core barrel assemblies, is particularly intended for use in conjunction with a wire line core barrel apparatus similar to that disclosed in U.S. Pat. No. 4,466,497, which is hereby incorporated by reference To safely retrieve an intact core sample from a drill hole, the core barrel must be properly located and securely maintained in place during drilling. In practice, a latch assembly is used to properly locate the core barrel with respect to the drill bit and lock the core barrel in place in the string. Commonly, a landing ring is fixed at a predetermined location upon the inside wall of the drill string at a specified distance above the bit, to indicate the proper location for the core barrel. A latch assembly is specially connected to the top of the core barrel. The latch assembly and core barrel are placed in the drill string. When the core barrel has been lowered to the proper location in a down hole, or has been hydraulically pumped up to the proper place in an up hole, the latch assembly contacts the landing ring, preventing the entire core barrel assembly from proceeding any further through the string.

It is essential, for personnel safety reasons as well as for efficient and economic core drilling and core sample retrieval, that the core barrel be held stationary (with respect to the drill string and bit) during drilling. To this end, the latch assembly includes elements to securely but releasably attach the locking assembly to the inside wall of the drill string immediately before, and during, drilling. Yet the ideal latch assembly is easily deliberately disengaged during drilling interruptions to allow the core sample to be retrieved to the earth's surface. U.S. Pat. No. 4,466,497 teaches an apparatus for accomplishing these foregoing objects.

However, because the latching process occurs out of sight, hundreds or thousands of feet up or down a hole, it can be difficult for drilling crews using known devices to determine if and when the latch assembly has contacted the landing ring and is securely locked to the drill string prior to commencing drilling. Perhaps even more importantly, it is also difficult for the crew to receive notice of instances when the latch assembly has become disengaged—often by popping slightly upward within a down hole, or slipping slightly down an "up hole"—from the drill string during drilling. Detachment of the latch assembly from the drill string, for any reason, while drilling is in progress can result in serious damage to the drilling equipment and/or destruction of the core sample, resulting in the loss of valuable time, subsurface geological data, and machinery. More critically, unanticipated or unnoticed disengagement of the latch assembly during drilling can pose a genuine risk of life-threatening injury to drill crew personnel, particularly to crews working on "up hole" rigs.

It is known in the art to provide elements upon a latch assembly which cause brief pressure fluctuations in the drill string for the purpose of notifying the rig crew when the latch assembly has landed. Unfortunately, prior devices send signals that are comparatively fleeting and can easily go unnoticed by the crew. Also, prior art devices may send false positive signals whenever the latch assembly becomes snagged or caught, however temporarily, in the drill string prior to landing on the landing ring.

Thus, there is a need for an apparatus that reliably indicates to a drill crew when the latch assembly has properly bottomed out and is locked in place within the string. A need also remains for such an indicating apparatus that encourages an affirmative conduct from the crew in response to the indication. Also, a need remains for an apparatus which automatically warns the crew when inadvertent disengagement has occurred. Such an apparatus preferably should be simple, affordably manufactured to encourage use, and extremely rugged to tolerate down hole conditions, elevated pressures, and rough handling in the field. Against this background, the following invention was developed.

SUMMARY OF THE INVENTION

An advantage of the invention is that the latch assembly signals the drilling crew when the latch assembly is in place prior to commending drilling, and also signals the crew if the latch assembly should become unlocked form the drill string during drilling. Signals are sent by marked fluctuations in drilling pressure. No delicate instrumentation is involved.

In accordance with the invention, there is provided a latching apparatus, movable in a subsurface drill string, for releasably securing a core barrel within the string, where the drill string includes a latch coupling with a recess therein, and the latching apparatus possesses elongate body with a movable latch thereon which is engageable into the recess, and wherein drilling fluid flows into the latch coupling to induce fluid pressure therein, and the latching apparatus also includes means for urging the latch into engagement with the recess, a seal for preventing discharge of drilling fluid between the latching apparatus and the latch coupling, a passage through the elongate body to allow drilling fluid to flow through the elongate body, and means, operably connected to said urging means, for closing the passage when the latch is disengaged from the recess. By this provision, a pressure signal is sent to the drilling crew when the latch is disengaged from the recess, causing a cessation in fluid flow.

In accordance with the invention there is further provided a latching apparatus, movable in a subsurface drill string, for releasably securing a core barrel within the string, the drill string having a plurality of members including a latch coupling with a recess therein, and the latching apparatus including an elongate body with a movable latch thereon which is engageable into the recess, wherein a drilling fluid flows into the drill string thereby inducing a fluid pressure therein, where the latching apparatus further incorporates a seal below the elongate body to prevent discharge of the drilling fluid between the latching apparatus and a drill string member, a passage through the elongate body for allowing drilling fluid to flow through the body, and a valve for damming the flow of drilling fluid through the passage, which is engageable while the latching apparatus moves along a drill string member and is releasable by fluid pressure when the latching apparatus ceases moving. By this provision, a pressure signal is sent to a drilling crew when the latch assembly contacts the landing ring and stops moving, thereby cutting of the free flow of drilling fluid.

The above and other objects of the present invention will become more readily appreciated and understood from a consideration of the following detailed description of a preferred form of the invention when taken together with the accompanying drawings.

BRIEF DESCRIPTION OF TEE DRAWINGS

DESCRIPTION OF A PREFERRED EMBODIMENT

As known in the art, a hole may be drilled into the earth's surface using a drill string. The drill string commonly includes, among other elements, a number of drill string members, usually specially fashioned hollow steel pipes connected in series, for transmitting rotary forces to a drill bit. In the vicinity of the drill bit, individual members of the drill string are customized to perform particular functions associated with the cutting action of the bit and the retrieval of the core sample from the string.

Figure 3:
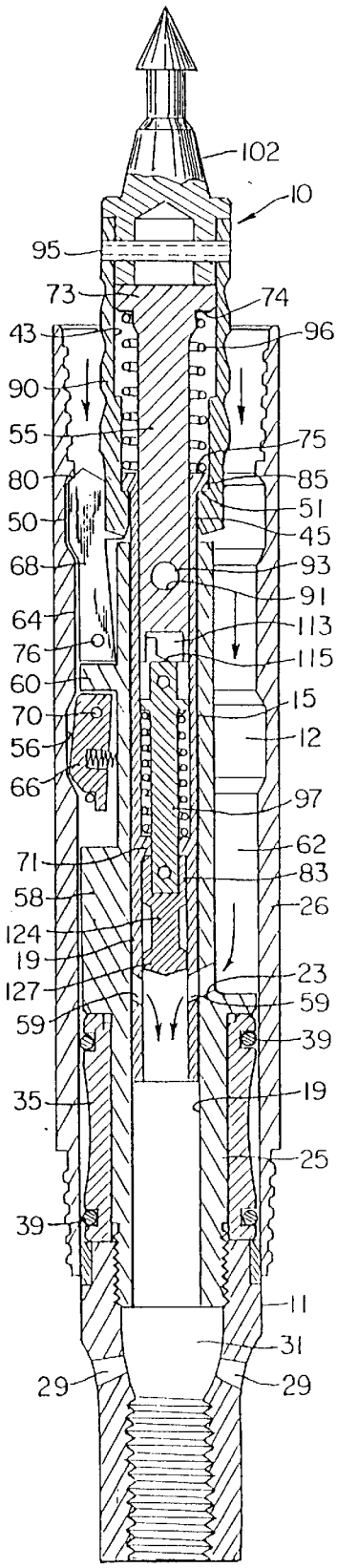
FIG. 3 is a longitudinal sectional view of the latch assembly sown in FIG. 1, showing the slide tube assembly disposed within the latch assembly.

Referring to the drawings, wherein like reference numerals and symbols designate the same elements, there is shown in FIG. 3 an individual particularly fashioned drill string member, specifically a generally cylindrically shaped latch coupling 26. When in use, each longitudinal end of the latch coupling 26 is conventionally connected to other members (not shown) of the drill string. The latch assembly is located in the drill string immediately above the landing ring (not shown) and a few meters above the drill bit, also according to convention in the art. Commonly, a stabilizer coupling (not shown) is connected to the upper end of latch coupling 26, and a plurality of ordinary string members (not shown) are connected in series to the top of and above the stabilizer coupling, extending up to the earth's surface.

Figure 1:
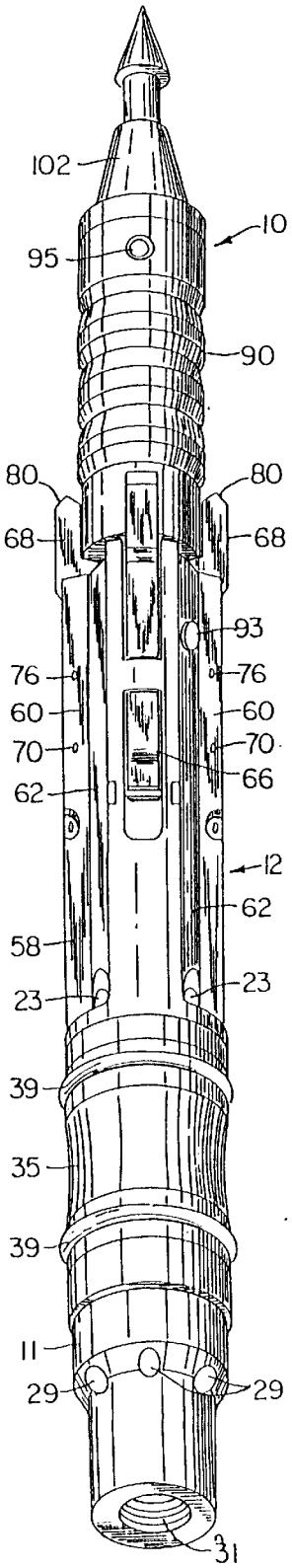
FIG. 1 is a perspective view of the retrieving assembly and the positioning assembly (together referred to as the latch assembly) of a preferred embodiment of the invention, depicting the latch assembly in a latched or "locked" position, where the retrieving assembly and the positioning assembly are in their closest relation.
Figure 2:
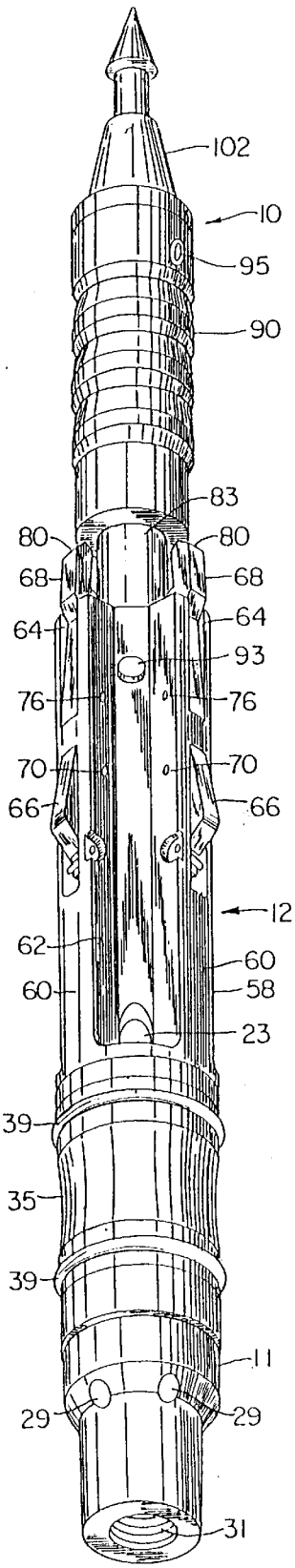
FIG. 2 is a different perspective view of the latch assembly shown in FIG. 1, depicting the latch assembly in an unlatched or "open" position, where the retrieving assembly and the positioning assembly are in an axially spaced apart relation.

The terms "up," "down," "top," "bottom," "upper," and "lower" will be used herein to describe the apparatus of the invention as it is oriented in FIGS. 1–3 of the drawings, i.e., with the apparatus oriented for use in a vertical "down hole," with the retrieval point 102 at the "top." It should be understood however, that the apparatus may be oriented in practically any position in space, including "upside down" with the retrieval point 102 directed downward in an "up hole" operation.

FIGS. 1–3 and 5 depict a latch assembly whose principal components include a retrieving assembly 10, a positioning assembly 12 and a bearing assembly adapter 11. Latch assembly functions as a component of a core barrel assembly to permit lengths of core sample to be withdrawn from the hole. As illustrated in FIG. 3, latch assembly is disposed within the latch coupling 26 in position for drilling. When in drilling position, the entire latch assembly rests upon the landing ring (not shown) at a predetermined fixed location along the drill string.

The general functions and operations of positioning assembly 12 and retrieving assembly 10, respectively, are essentially the same as previously described in U.S. Pat. No. 4,466,497 to which reference should be made. Retrieving assembly 10 is connected to positioning assembly 12 by means of a slide tube assembly 15. Positioning assembly 12 is provided with axial central bore hole 19 therethrough, in which slide tube assembly 15 is slidably disposed. A main retainer pin 93, inserted through co-aligned holes in positioning assembly 12 and slide tube assembly 15 maintains the interconnection between the components. A difference between the apparatus of U.S. Pat. No. 4,466,497 and the present invention resides in the provision and configuration of the slide tube assembly 15, which regulates the flow of drilling fluid (e.g., air, water, or drilling mud) through the latch assembly as described in greater detail herein.

Positioning assembly 12 includes a generally cylindrical elongate body 58 having two or more, preferably three, angularly spaced longitudinal ribs 60 which extend radially outward from body 58. Each rib 60 possesses a radial extension slightly less than the interior radius of latch coupling 26, so that each rib 60 is closely spaced from the interior wall of latch coupling 26 when the latch assembly is in drilling position. Each adjacent pair of ribs 60 define a channel 62 therebetween. Channels 62 provide a longitudinal void space through which drilling fluids may flow between elongate body 58 and the inner wall of latch coupling 26.

Elongate body 58 is provided along its axial length with a central bore hole 19 in which slide tube assembly 15 is disposed in coaxial relation. The various components of slide tube assembly 15 substantially occupy the central bore hole 19.

Each longitudinal rib 60 on elongate body 58 is provided with a longitudinal slot 64 opening at the upper end of positioning assembly 12. Slot 64 houses a pair of latches, specifically a locking dog 66 and a latch dog 68. Locking dog 66 and latch dog 68 both function essentially as described in U.S. Pat. No. 4,466,497. Locking dog 66 is radially pivotable about a pin 70 extending therethrough and through the corresponding rib 60. A compression spring disposed within each slot 64, between locking dog 60 and the elongate body 58, biases at least some portion of the corresponding locking dog 66 radially outward from positioning assembly 12 for engagement with the interior wall of the drill string.

When the latch assembly is properly positioned for drilling, as shown in FIG. 3, a compression spring acts upon locking dog 66 to pivot the dog about pin 70, causing a portion of the dog 66 to protrude into a longitudinal locking dog slot 56 in the inside wall of latch coupling 26. With the locking dog 66 engaged in the recess of the locking dog slot 56, powered rotation of the drill string is transmitted via the locking dog 66 to the positioning assembly 12, and the positioning assembly is prevented from rotating independently of the drill string. As known in the art, a free-wheeling bearing assembly (not shown), connecting the positioning assembly 12 to the inner core barrel (not shown), permits the drill string to rotate relative to the inner barrel tube during drilling and the core barrel thus remains stationary relative to the core sample.

Continued reference is made to FIGS. 1–3 and 5. Each longitudinal slot 64 in each rib 60 also partially houses a latch dog 68. Each latch dog 68 is pivotable about a pin 76 extending through the lower portion thereof and through the corresponding rib 60. Each latch dog 68 features an upper head section 80 having its outside surface shaped correspondingly to the contour of an annular groove 50 in the latch coupling 26. Accordingly, the head 80 of each latch dog 68 may be pivoted about pin 76 to protrude into and be maintained within annular groove 50. The uppermost and lowermost edges of the latch dog 68 are beveled to promote the latch dog's riding freely over minor discontinuities and defects on the interior wall of the drill string as the latch assembly is moved into, or withdrawn from, the drill string. But when the latch dog 68 is engaged with the annular groove 50, the entire latch assembly is prohibited from longitudinal translation in the latch coupling.

Figure 5:
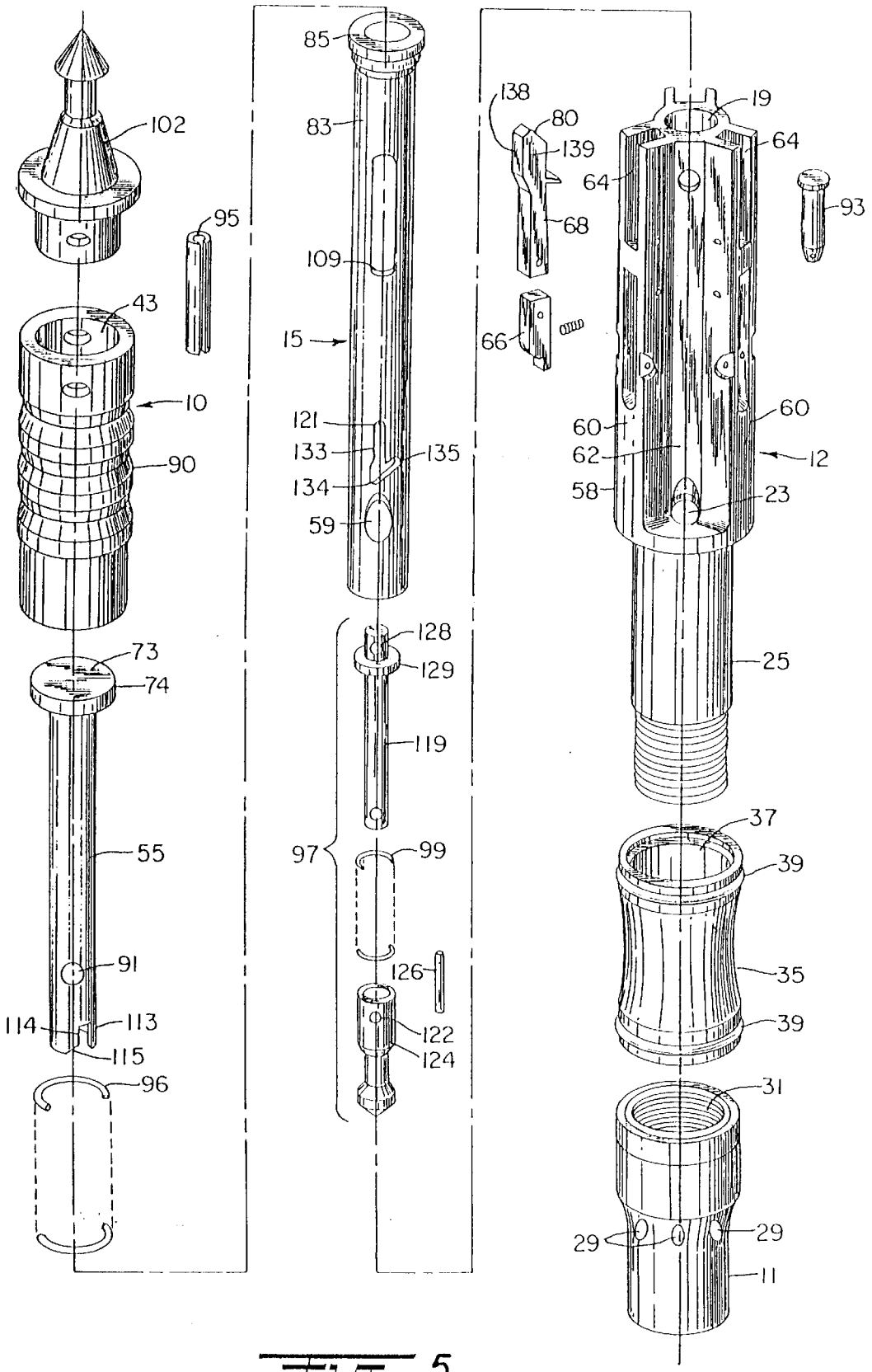
FIG. 5 is an exploded view of the latch assembly shown in FIG. 1.

The latch dogs 68 are prone to wear. Advantageously, the wear does not generally occur at the heads 80, which are most critical to the latching function, but rather along the outside surface 138 which rubs along the drill string inner wall as the latching assembly moves therethrough. An engraved wear warning line 139 may be provided at the appropriate location on the dog 68 to signify dangerously excessive wear of the dog, thereby alerting the user of the need to replace the dog, as best shown in FIG. 5.

Within each channel 62, preferably at the respective lower end thereof, lateral fluid entry port 23 penetrates the wall of elongate body 58, and opens into the central bore hole 19. Thus, in the preferred embodiment, three entry ports 23 are radially spaced about the elongate body 58. Lateral entry port 23 permits drilling fluid flow from the exterior channel 62 into central bore hole 19, and the central bore hole 19 and the entry port 23 thus serve as a passage providing fluid communication between each channel 62 and the longitudinal ends of the central bore hole 19.

Depending from and integral with the lower end of elongate body 58 is a tubular stem 25. Central bore hole 19 extends through and is longitudinally downward coextensive with stem 25, so that central bore hole 19 comprises a continuous void running from the top of positioning assembly 12 to the bottom end of stem 25. The exterior of the lower end of stem 25 is threaded to screw into the upper end of a correspondingly threaded hollow bearing assembly adapter 11.

Bearing assembly adapter 11 also is provided with an axial throughbore 31 which, when adapter 11 is screwed into place upon stem 25, is aligned with central bore hole 19 in stem 25. Bearing assembly adapter 11 has at least one, but preferably a plurality, of equi-angularly spaced discharge orifices 29 which permit fluid flow from throughbore 31 to the exterior of the adapter.

The lower portion of bearing assembly adapter 11 is threaded to receive any of a variety of bearing assemblies (not shown) known in the art. The bearing assembly permits a rotatable connection between the latch assembly and the inner tube (not shown) in which the core sample is collected. During drilling, the drill string (including the latch coupling 26 and latch assembly) rotates, while the inner tube and core sample do not, as per conventional practice. The bearing assembly adapter 11 provides a fixed longitudinal connection between the latch assembly and the bearing assembly, such that the latch assembly and core barrel translate longitudinally as a single unit within the drill string.

Collar 35 is secured upon positioning assembly 12. Collar 35 is generally cylindrical with a longitudinal dimension less than the length of stem 25 and an outside diameter just less than the inside diameter of latch couple 26. Collar 35 is provided with an axial smooth-walled tunnel 37 therethrough having a radius just greater than the outside radius of stem 25. Collar 35 is mounted upon stem 25 by the slidable insertion of the stem 25 through the collar tunnel 37 until stem extends out the opposite side of the collar 35. Collar 35 is held in place upon stem 25 by bearing assembly adapter 11, which is screwed upon the protruding end of the stem until the collar is securely clamped between the adapter and the bottom of elongated body 58.

An O-ring 39 is seated around the exterior circumference of each longitudinal end of the collar 35. The O-rings 39 provide a fluid seal between collar 35 and inside wall of latch couple 26, while yet permitting collar 35 and positioning assembly 12 to slide up and down within the drill string.

Notably, slide tube assembly 15 occupies most of the upper central bore hole 19 in elongate body 58 and the gasketed seal provided by the O-rings 39 upon collar 35 prevents significant fluid discharge between the collar 35 and the inside wall of latch couple 26. Consequently, the channels 62, the fluid entry ports 23, the lower reaches of central bore hole 19, and the throughbore 31 and discharge orifices 29 in adapter 11 collectively provide the sole pathway for functionally significant flow of drilling fluid past the positioning assembly 12 toward the drill bit.

Reference is made to FIG. 3. Drilling fluid flows down, or is pumped up, the drill string and through the annulus defined by the retrieving assembly 10 and the wall of latch coupling 26. The central bore hole 19 is substantially blocked by the slide tube assembly 15 components, and the longitudinal grooves 64 housing the dogs 66, 68 have closed bottoms, so fluid flow is then directed primarily into the peripheral channels 62, between the elongate body and the inside wall of latch coupling 26. Flow is along each channel 62, through the entry ports 23 into the central bore hole 19 and thence through the stem 25, along the throughbore 31 and then out the discharge orifices 29 in bearing assembly adapter 11, toward the drill bit, as shown by the directional flow arrows of FIG. 3. When the entire latch assembly is located within a drill string, substantial volumes of drilling fluid may flow past the latch assembly only via the fluid entry ports 23 in the elongate body 58 of the positioning assembly 12.

FIGS. 1–3 and 5 show that retrieving assembly 10 includes a generally cylindrical housing 90 enclosing a plunger cavity 43 within which main compression spring 96 is contained. Plunger cavity 43 is open to the housing exterior via plunger hole 45. Rigidly and non-rotatably fixed, as with a housing pin 95, to the upper end of housing 90 is retrieval point 102, whose topmost portion is adapted to be grasped by conventional retrieval tools. Retrieval point 102 closes and defines the upper extent of plunger cavity 43, so that plunger cavity 43 is open to the exterior solely by way of plunger hole 45. Plunger cavity 43 has regions of different diameters, with the uppermost region having the greatest diameter and the lower region having a lesser diameter, so to define an annular plunger stop shoulder 75 at an intermediate location within the cavity. The bottom of housing 90 around plunger hole 45 defines an annular inwardly extending check shoulder 51.

Figure 4A:
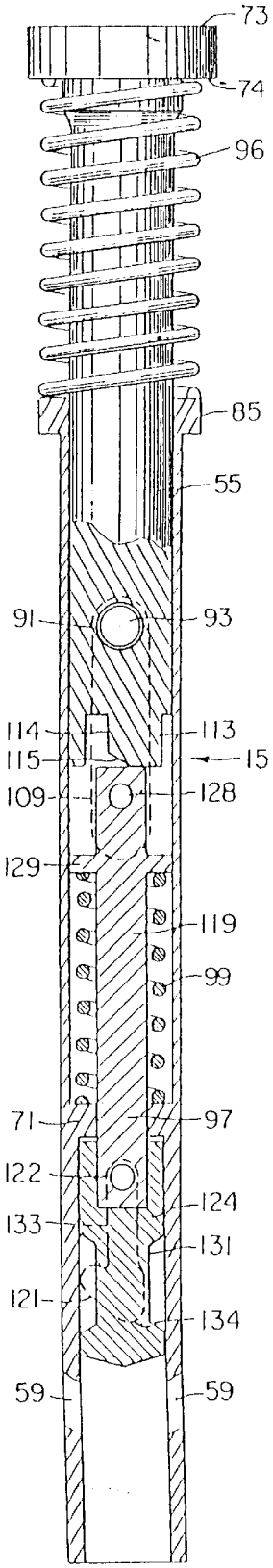
FIG. 4A is an enlarged longitudinal sectional view of the slide tube assembly shown in FIG. 3, depicting the slide tube assembly in a rest or uncocked configuration.

As seen in FIGS. 3, 4A, and 5, main shaft 55 is disposed concentrically within and in sliding contact with slide tube 83, and the upper portions of both the main shaft and slide tube 83 extend through plunger hole 45 and into plunger cavity 43. The top of main shaft 55 features a plunger head 73 defining a radially extending head flange 74 which is in slidable contact with housing 90. Main compression spring 96 is compressibly restrained between head flange 74 of main shaft 55 and a top shoulder 85 on the slide tube 83.

Figure 4B:
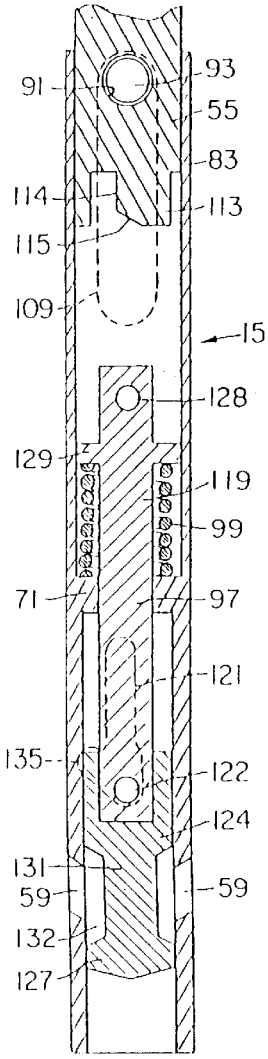
FIG. 4B is a longitudinal sectional partial view of the slide tube assembly shown in FIG. 3, depicting the slide tube assembly in a pressure-extended configuration.
Figure 4C:
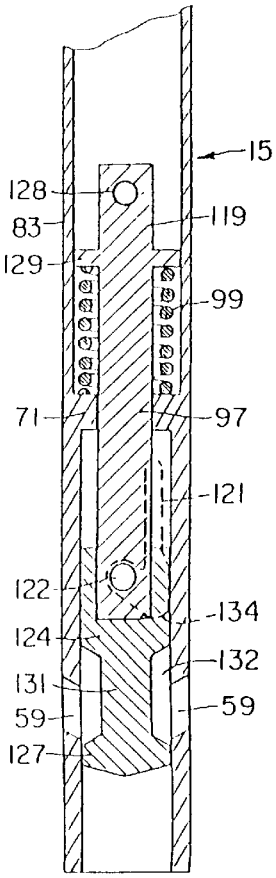
FIG. 4C is a longitudinal sectional partial view of slide tube assembly shown in FIG. 3, depicting the slide tube assembly in the cocked configuration.

Reference is made to FIGS. 4A–C showing enlarged views of the slide tube assembly 15, which is disposed partially within the housing cavity 43 and partially within the central bore hole 19 in positioning assembly 12. The extreme bottom portion of the slide tube assembly 15 protrudes into the interior of the stem 25 of the positioning assembly. The principal components of slide tube assembly 15 are main shaft 55, main compression spring 96, check valve assembly 97, slide tube 83, and valve spring 99, all of which preferably are coaxially aligned and are operationally interrelated.

Slide tube 83 comprises a durable steel tube, open at each end, whose wall is penetrated by various intermediately located orifices and slots to be further described. Slide tube 83 is long enough to reach from the housing 90 to substantially past the ports 23 in elongate body 58 even when the retrieving assembly 10 is moved axially apart from the positioning assembly 12. Slide tube 83 features about its top end a radially outward protruding top shoulder 85. The interior of tube 83 has, at a predetermined intermediate location, an abbreviated portion of reduced diameter defining an annular ledge 71. As best depicted in FIG. 3, main compression spring 96 strongly biases the top shoulder 85 of slide tube 83 against check shoulder 51 of housing 90. The shoulder 85 is substantially constantly held against the check shoulder 51 of the housing 90 by the force of the spring 96.

As shown in FIGS. 4A–C and 5, substantially proximate to the upper end of slide tube 83 and in diametrically opposed relation through the wall of the tube are a pair of longitudinal pin slots 109. Pin slots 109 function in conjunction with main pin 93 to provide a slidable connection so that tube 83 may move axially, but not radially, with respect to the elongate body 58. The ends of main pin 93 extend through the walls of elongate body 58, preventing main shaft 55 from moving at all with respect to the elongate body.

Figure 7:
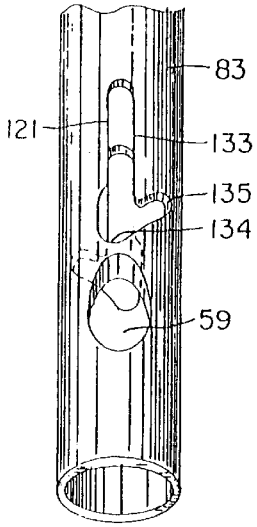
FIG. 7 is an enlarged perspective view of an end portion of the slide tube component depicted in the latch assembly shown in FIG. 5.

FIGS. 3, 5, and 7 show that slide tube 83 also has at least one, and preferably three, equi-angularly radially spaced apertures 59 penetrating the tube wall near, but axially spaced from, the lower end of the tube. Each aperture 59 preferably penetrates at a downward angle of approximately thirty to fifty degrees from the vertical to promote inward passage of drilling fluid. Should ease of machining so dictate, the apertures 59 alternatively may penetrate the tube 83 perpendicularly, precisely radially to the axis.

Generally adjacent to apertures 59, longitudinally intermediate between the apertures and pin slots 109, is at least one, and preferably two, J-slots 121, as best shown in FIGS. 5 and 7. In the preferred embodiment, J-slots 121 are in diametrically opposed relation on tube 83. J-slots 121 preferably, but not necessarily, are also radially aligned with pin slots 109. J-slots 121 function in conjunction with lower valve pin 122 to provide a functional interconnection between check valve assembly 97 and the slide tube 83.

Main shaft 55 preferably comprises a solid steel rod with a principal radius slightly less than the inside radius of slide tube 83, so that lower extension of shaft 55 may be inserted into the upper interior of tube 83 in smooth sliding contact, as suggested in FIGS. 4A and 5. FIG. 1 shows that plunger head 73 of the main shaft is strongly urged against the bottom of retrieval point 102 by the action of main compression spring 96. Plunger head 73 may be moved against the force of spring 96, but the extent of its motion is restricted by the contact of head flange 74 with stop shoulder 75.

Figure 6:
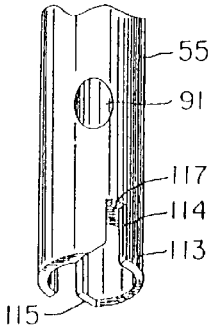
FIG. 6 is an enlarged perspective view of an end portion of the main shaft component depicted in the latch assembly shown in FIG. 5.

Main pin hole 91 diametrically and completely penetrates main shaft 55 proximate to its lower end, as shown in FIGS. 5 and 6. Main pin hole 91 is radially alignable with the pin slots 109 in slide tube 83, so that when main pin 93 is disposed through the pin hole, the pin slots, and corresponding holes in elongate body 58, the main shaft 55 is linked to the slide tube but the tube may slide axially upon shaft 55. The sliding movement of tube 83 is limited longitudinally by the contact of main pin 93 with the ends of the slots 109.

Main shaft 55 is substantially immovable with respect to the positioning assembly 12, due to the fixed interconnection therebetween provided by main pin 93. The retrieving assembly 10, however, is axially movable with respect to the positioning assembly 12 as plunger head 73 of main shaft 55 moves up and down (against the force of main compression spring 96) within housing 90.

The bottom of main shaft 55 is specially configured to operatively interact with the upper end portions of the check valve assembly 97. As best illustrated in FIG. 6, the lower end of main shaft 55 features a pair of longitudinally extending, semicylindrical fingers 113 defining and separated by a pair of pin notches 114. The extreme edge of each main shaft finger 113 is provided with a helical bearing surface 115 between the bottom of the finger and one associated pin notch 114. Each pin notch 114 corresponds with a single associated angled or beveled surface 115.

Combined reference is made to FIGS. 4A–C. Ease of invention assembly recommends that check valve assembly 97 be constructed of two securely joined elements. Check valve assembly 97 preferably includes steel components, specifically a spring shaft 119 and a piston 124 securely connected as by a diametric pin 126 (or 122), and coaxially disposed within slide tube 83.

Spring shaft 119 is a solid cylindrical steel rod with an outside diameter substantially smaller than the inside diameter of slide tube 83. Diametrically disposed through spring shaft 119, proximate to its top end, is upper bearing pin 128 each end of which protrudes radially from the spring shaft. Each end of the upper bearing pin 128 is radially aligned with, and contactable a certain times with, a corresponding beveled surface 115 and pin notch 113 on main shaft 55. The radial extension of each end of upper bearing pin 128 is, however, less than the inside radius of slide tube 83 so that upper bearing pin 128 does not contact slide tube. Spring shaft 119 is slidably disposed through the constricted bore defined by annular ledge 71.

Spaced axially downward from upper bearing pin 128 is annular spring lip 129 about the circumference of, and preferably integral with, spring shaft 119. Spring lip 129 has a radial extension just less than the inside radius of slide tube 83, so that the circumferential edge of spring lip 129 is in slidable contact with the inside wall of slide tube 83 to maintain spring shaft 119 in coaxial relation to slide tube 83. As best shown in FIGS. 4A–C and 5, helical valve spring 99 is compressibly disposed around spring shaft 119 and bears upon the underside of spring lip 129. Valve spring 99 also contacts the annular ledge 71 on the tube 83 with the result that the check valve assembly 97 is biased upward in the tube by the action of valve spring 99.

Piston 124 is immovably attached to the bottom end of spring shaft 119 so that the piston and spring shaft move as an integral unit. Piston 124 is a generally cylindrical solid steel rod with a radius just less than the inside radius of slide tube 83, so that piston portion is in slidable contact with the inside wall of slide tube 83 to maintain piston portion in coaxial relation within slide tube. An intermediate section of piston 124 has a comparatively reduced radius to define a narrowed trunk 131 axially connecting the piston to the piston tail 127. Trunk 131 and the slide tube 83 thus define an annular void 132, between the piston and the piston tail 127, in which fluid may flow as shown in FIGS. 3 and 4A–C.

Piston 124 has a lower bearing pin 122 disposed diametrically therethrough so that both ends of the pin protrude radially outward beyond the circumference of piston 124. Lower bearing pin 122 preferably but not necessarily is radially aligned with upper bearing pin 128. The radial extension of each end of the lower bearing pin 122 exceeds the inside radius of the slide tube 83, and the ends of pin 122 are axially aligned with and protrude through the J-slots in slide tube 83. The ends of the pin 122 thereby are operatively engageable with the J-slots 121. The upward movement of the check valve assembly 97 is limited by the confinement of lower bearing pin within J-slot 121.

Reference is made to FIG. 7. Each J-slot 121 comprises a longitudinal neck 133, a peak 134, and a radially offset catch 135. Catch 135 has substantially the same orientation, with respect to the apparatus axis, as the beveled surface 115 upon the end of main shaft 55. The J-slots 121 are positioned along the axial length of slide tube 83 and check valve assembly 97 is proportioned to provide functional relationship between the position of lower bearing pin 122 in J-slot 121 and the axial position of piston 124 within the lower end of slide tube 83. The neck 133 of J-slot 121 is broadened somewhat in the vicinity of its intersection with catch 135. The side of the slot 121 opposite the catch 135 is recessed somewhat to allow the lower bearing pin 122 to move slightly to that side of the neck axis to eliminate spring twist that may occur in valve spring 99.

More specifically, when lower bearing pin 122 is at the top end of the neck 133 as shown in FIG. 4A, (the normal position, to which the pin is urged by valve spring 99), the piston tail 127 is situated axially above the slide tube apertures 59. In this configuration, drilling fluid may freely flow through the apertures 59 and out the bottom of tube 83. When check valve assembly 97 is moved downward (as by fluid pressure) against the force of valve spring 99 so that lower bearing pin 122 is located somewhere along the length of neck 133, piston tail 127 is moved equidistantly to a position corresponding axially with tube aperture 59, so that flow of drilling fluid through the apertures is progressively impeded my the moving piston tail.

When the check valve assembly 97 has moved to its maximum downward position, lower bearing pin 122 is at the peak 134 of the J-slot 121, and there contacts the wall of the tube 83 as depicted in FIG. 4B. When the lower bearing pin 122 is disposed at the peak 134 of the J-slot 121, the piston tail 127 is entirely below the apertures 59 but still in contact with the inside wall of the tube 83, thus damming the tube 83, substantially completely arresting the flow of drilling fluid from apertures 59 to and out the bottom of the tube. In this maximally distended position of check valve assembly 97, as shown in FIG. 4B, the narrow trunk portion 131 of the piston 124 is longitudinally aligned with the apertures 59, thus permitting drilling fluid to flow through the apertures 59 and against the top of piston tail 127.

If the valve check assembly 97 is then rotated radially (as by interaction with main shaft 55) to dispose lower bearing pin 122 within catch 135, the piston tail 127 remains in position axially below the apertures 59 to substantially prevent drilling fluid from flowing through the bottom of the tube 83, as illustrated in FIG. 4C. Because valve spring 99 urges check valve assembly 97 upward, valve spring 99 tends to hold lower bearing pin 122 in the catch 135 unless and until the spring is further compressed and the check valve assembly 97 rotated to align the bearing pin with the neck 133 of the J-slot 121.

As shown in FIG. 2, and as more fully described in U.S. Pat. No. 4,446,497, the latch dogs 68 may pivot radially inward only when the retrieving assembly 10 is translated axially upward to a maximally extended position away from positioning assembly 12. In the maximally extended position, which is attained when head flange 74 contacts stop shoulder 75 within housing 90, the housing is sufficiently spaced apart from the top of positioning assembly 12 to permit the latch dogs 68 to move radially inward between the bottom of housing 90 and the top of elongate body 68. With the latch dogs in the radially inward displaced position (FIG. 2), the latch assembly is free to translate up and down the drill string.

Lower end of housing 90 therefore acts essentially as a plunger against the heads 80 of the latch dogs 68 to urge them radially outward into a locking position. The outer radial region of the lower end of housing 90 is mildly chamfered to engage a correspondingly chamfered upper edge of each latch dog head 80. The periphery of the lower end region of housing 90 very slightly increases in diameter progressing upward from the bottom chamfered edge. The inside edge of each latch dog head correspondingly very slightly tapers in then opposite direction. When the lower end of the housing 90 urges the latch dogs 68 into the annular groove 50, the tapers of the lower periphery of the housing 90 and inner edges of the latch dogs 68 resist forces which otherwise would tend to move the housing 90 upward, thereby allowing latch dogs to pivot out of the annular groove 50.

The lower end of housing 90 ordinarily is in contact with the chamfered upper edge of the head 80 of each latch dog 68 due to the force of main compression spring 96. Main compression spring 96 maintains main shaft plunger head 73 against retrieval point 102, while also pressing against tube top shoulder 85 which in turn presses down upon check shoulder 61 to urge housing 90 toward positioning assembly 12, which in turn urges the latch dog heads 80 into engagement with the annular groove 50, as depicted in FIGS. 2 and 3. An advantage of the invention is that any hydraulic pressure gradient between the plunger cavity 43 in housing 90 and the exterior of the housing acts upon the upper surface of the slide tube shoulder 85, tending to urge the slide tube 83 downward. Thus, under pressurized conditions, the housing 90 nevertheless is pushed down somewhat to supplement the force of spring 96 in maintaining the heads 80 in the engaged and locked position.

Combined reference is made to FIGS. 1–3. The length of slide tube assembly 15 is particularly coordinated with the length of the elongate body 58 to provide an important functional spacial relationship between the apertures 59 in the slide tube 83 and the fluid entry ports 23 in the elongate body. As mentioned, main compression spring 96 biases the housing 90 downward by holding the main shaft plunger head 73 against the retrieval point 102 while pushing tube top shoulder 85 against check shoulder 51. (Main shaft 55 itself is immobilized with respect to the elongate body 58 by main pin 93 alignably disposed through round holes in the shaft 55 and the elongate body 58.) When the latch assembly is in its rest or "locked" position, main compression spring 96 thus biases slide tube 83 downward in the central bore hole 19 in the positioning assembly 12. When the slide tube 83 is in this maximally downward extended position (limited by contact of top shoulder 85 with check shoulder 51 in housing 90), the apertures 59 in the tube 83 are axially and radially aligned with the fluid entry ports 23 in the elongate body 58, allowing drilling fluid to flow through the ports 23 and apertures 59 into the interior of the tube as shown in FIG. 3.

However, in instances when main compression spring 96 is substantially axially compressed (as by the weight of a core sample hanging from the adapter 11, which is screwed to the bottom of elongate body 58), the retrieving assembly 10 moves apart from the positioning assembly 12 as the main shaft head flange 74 is pulled down within plunger cavity 43 and the housing 90 is drawn upward with respect to positioning assembly 12. Due to contact of top shoulder 85 of slide tube 83 with check shoulder 51 at the bottom of housing 90, upward translation of the housing (with respect to both the main shaft 55 and the elongate body 58) is concurrently accompanied by a corresponding upward sliding movement of slide tube 83 within central bore hole 19. Main pin 93, which fixes main shaft 55 to elongate body 58, translates longitudinally within pin slots 109 in slide tube 83, allowing slide tube 83 to move axially with respect to main shaft 55.

Significantly, if and when the slide tube 83 is pulled substantially upward within the central bore hole 19 of the elongate body 58, such translation moves the apertures 59 in the tube 83 out of axial alignment with the fluid entry ports 23 in the elongate body 58. With the apertures 59 and ports 23 substantially out of alignment, the wall of the slide tube 83 closes the fluid entry ports 23 and terminates drilling fluid flow therethrough. Accordingly, at such time as the retrieving assembly 10 is pulled, against the force of the main compression spring, away from positioning assembly 12 to an extended position axially spaced apart from positioning assembly, the slide tube 83 likewise is pulled to a position where it shuts the fluid entry ports 23 to prevent drilling fluid flow to the drill bit.

In practice, the various elements of the invention are arranged to interact effectively to assure that drilling fluid may freely flow past the latch assembly to the drilling bit when and only when the latch dogs 68 are fully engaged into the annular groove 50 in the latch coupling 26. Optimum drilling fluid free flow exists only when the retrieving assembly 10 and positioning assembly 12 are substantially adjacent and the slide tube 83 therefore is fully inserted into the positioning assembly 12, as shown in FIGS. 2 and 3. The lack of a free flow provides valuable signals to the operator.

To realize all the advantages of the preferred embodiment of the invention., the operator first manipulates the latch assembly prior to placing it within the drill string. At the outset, the piston tail 127 is above the apertures 59 in the tube 83, thus allowing fluid flow therethrough (FIGS. 3 and 4A). The operator "cocks" the slide tube assembly 15 by physically pulling the retrieving assembly 10 away from positioning assembly 12. This may readily be done manually by grasping the outside of the housing 90 (a gripping surface may be provided for this purpose) and the exterior of the positioning assembly elongate body 58, and pulling them away from each other. Because the main shaft 55 is pinned in a fixed position with respect to elongate body 58, housing 90 effectively is lifted, pulling slide tube 83 with it, against the force of main compression spring 96. As the retrieving assembly 10 moves away from the positioning assembly 12, the main pin 93 slides along main pin slots 109 in sliding tube 83 while the tube moves upward within the central bore hole 19.

With continued withdrawal of retrieval assembly and positioning assembly away from each other, the movement of slide tube 83 (and thus check valve assembly 97) continues until upper bearing pin 128 contacts a corresponding radially aligned finger 113 on the main shaft 55 shaft, as suggested in FIG. 4A. As movement of the slide tube 83 continues, the stationary main shaft 55 pushes the check valve assembly 97 down the tube 83 and against the force of the valve spring 99. Main pin 93 penetrates elongate body 58, main shaft 55, and slide tube 83 to prevent radial movement of those elements respect to each other; radial confinement of lower bearing pin 122 within the neck 133 of the J-slot 121 prevents check valve assembly from rotating within the slide tube 83.

The operator continues the pulling separation action (now against the force of both springs 96, 99) to urge the check valve assembly 97 axially down the tube 83 as a result of the movement of main shaft 55. Lower bearing pin 122 slides along the neck 135 of J-slot 121 until the lower bearing pin is axially adjacent to the catch 135 in the J-slot. When lower bearing pin 122 is adjacent to catch 135, the bearing pin is no longer radially confined in the neck 133, but rather is freely moves into the catch 135. Continued axial movement of the main shaft 55 causes beveled bearing surface 115 on each finger 113 to impart, via the upper bearing pin 128, a rotary force upon the check valve assembly 97. This rotary force imparted by the translational movement of the main shaft 55 effectively rotates the entire check valve assembly 97 within the slide tube 83, causing lower bearing pin 122 to pop into the catch 135 with an audible click or snap. Valve spring 99 urges the check valve assembly 97 upward in the slide tube 83, thus releasably holding the lower bearing pin 122 in the catch 135.

The slide tube assembly 15 is now in the "cocked" position shown in FIG. 4C, and the operator releases the retrieving assembly 10 which is immediately pulled back toward the positioning assembly 12, and into the closed or locked position, by the action of the main compression spring 96. The slide tube assembly 15, however, remains in the cocked position, with the lower bearing pin 122 held within catch 135 at the urging of valve spring 99. Overall, the process of cocking the slide tube assembly involves translating the slide tube 83 along the main shaft 55 a comparatively short distance (e.g., about 2.0 cm), not an unduly difficult task for the typical rig crew member, despite the typically considerable force of the main compression spring 96.

With the slide tube assembly 15 in the cocked position, the piston tail 127 is below the apertures 59 (FIG. 4C), and drilling fluid is prevented from flowing from the apertures through the tube and on past the latch assembly. The only otherwise available route of substantial discharge is through the entry ports 23 and apertures 59 and out through the bottom of the slide tube 83 and through the stem 25. The latch assembly is lowered down or hydraulically pumped up the drill string in this cocked configuration.

In the operation of the invention, a cable or other line (not shown) is then attached to a pick up device (not shown) which is used to grasp the retrieval point 102 on the retrieving assembly 10. The latch assembly, together with the bearing assembly and the inner tube core barrel, is then suspended by the retrieval point 102 and lowered, as by a winch or the like, down a down hole drill string. Alternatively, the latch assembly may be inserted (positioning assembly 12 first) into an up hole, and water pumped into the drill string behind and below it to push it up the drill string. Drilling fluid typically is then pumped into the drill string to promote upward or downward movement and lubrication of the latch assembly. The latch dogs 68 move inward to allow the entire latch assembly to fit in the drill string, and the radial confinement of the drill string members hold the dogs 68 between the retrieving assembly 10 and the positioning assembly such that the housing 90 assembly is spaced axially away from the elongate body 58 as shown in FIG. 2.

When the latch assembly has been raised or lowered the proper distance, and contacts the landing ring, the bias of the compression spring 96 forces the housing axially downward such that its lower end forcefully contacts the chamfered inner edge of each latch dog head 80, thereby forcing each latch dog head 80 radially outwardly and into the annular groove 50 of the latch coupling 26 (FIGS. 1 and 3). Upon rotation of the drill string, the locking dog 66 also is forced into its corresponding locking dog slot 56 in the latch coupling 26, and the latch assembly is in position to commence actual drilling. Because the latch assembly is in the "locked" position, i.e., the retrieving assembly 10 is substantially adjacent to the positioning assembly 12 to push the latch dogs 68 outward, the apertures 59 in the slide tube 83 also are aligned with the entry ports 23 in the positioning assembly 12.

The advantages offered by the present invention are now highlighted. Formerly, it was difficult for the drill crew to ascertain when the latch assembly had bottomed out on the landing ring and when the latch dogs 68 had fully engaged the annular groove 50. The invention signals the operator, by way of fluid pressure changes, when these conditions are attained.

As mentioned, drilling fluid is pumped into the drill string behind (above) the latch assembly when the assembly is placed in the hole. When the latch assembly has contacted the landing ring, the latch assembly stops moving and the invention automatically abruptly increases the fluid pressure in the drill string between the latch assembly and the earth's surface, to signal that the assembly is "bottomed." Because the slide tube assembly 15 is cocked to place the piston tail 127 in a location completely damming fluid flow through or past the positioning assembly 12 (FIG. 4C), no significant drilling fluid will discharge past the latch assembly and on toward the bit until the slide tube assembly 15 is uncocked.

Upon reaching the landing ring, the latching assembly ceases moving along the drill string. Continued pumping of drilling fluid, however, increases the pressure head between the now stationary positioning assembly 12 and the earth's surface, because the fluid cannot flow through the tube 83 past the piston tail 127. The increasing pressure acts through the co-aligned fluid entry ports 23 and apertures 59 upon the annular upper surface of the piston tail 127. The resulting tremendous force upon the top of the piston tail 127 pushes the tail (and the entire check valve assembly 97) against the force of the valve spring 99 and downward in the slide tube 83. The downward slippage of piston tail 127 pulls lower bearing pin 122 along the side of the J-slot 121, toward the peak 134 therein, until the lower bearing pin is cleared out of catch 135 (FIG. 4B).

At this point, the pressure in the drill string will have reached unusually high levels, thus signaling the crew that the latch assembly is no longer moving and probably has landed. (Extremely excessive pressures trip a relief valve at the drillers station.) The crew, observing the elevated pressure, is informed that the latch assembly has bottomed out, since pressure is otherwise relieved by movement in the string of the entire latch assembly. Once the crew is confident that the latch assembly has landed in the proper location, they then affirmatively respond to the landing signal by relieving the elevated pressure.

With the relief in pressure, the valve spring 99 effectively pushes the check valve assembly 97 upward in the slide tube 83, and the lower bearing pin 122 slides up to the top end of neck 133 in J-slot 121, to the rest position of FIG. 4A. This upward movement of the whole check valve assembly 97 pulls the piston tail 127 to a location above the apertures 59 in the slide tube and the entry ports 23 in the elongate body, permitting free discharge of drilling fluid therethrough to the bit. Drilling fluid flows through the co-aligned apertures 59 and ports 23, into the interior of the slide tube 83, on down the central bore hole 19 in stem 25, down the throughbore 31 in adapter 11, out the discharge orifices 29, and to the bit. Thus having been signalled that the latch assembly has bottomed out, and with adequate fluid flow past the latch assembly, the crew may commence drilling with confidence. The invention thus discourages inadvertent premature commencement of drilling, since free flow of drilling fluid commences only after the crew has acknowledged and confirmed the landing signal by deliberately relieving the indicating high pressure.

The other advantage of the invention is realized if, during drilling, the positioning assembly 12 becomes disengaged from the latch coupling 26. An object of the invention is to signal the operator when disengagement occurs, so that drilling can be immediately interrupted.

Occasionally during drilling, for a variety of reasons, retrieving assembly 10 creeps upward or downward within latch coupling 26 against the force of the main compression spring 96. If significant creep occurs to allow latch dogs 68 to pivot radially inward any significant degree, the engagement of the latch assembly within the drill string is jeopardized. The invention signals the jeopardy by automatically terminating the free flow of drilling fluid past the latch assembly in the event of significant creep of the retrieving assembly.

The invention exploits the fact that the latching dogs 68 normally cannot disengage from the annular groove 50 unless the retrieving assembly 10 has moved axially to some position spaced apart from positioning assembly 12, for example as shown in FIG. 2. As previously mentioned, the latch dogs 68 extend from the positioning assembly 12 for complete engagement with the annular groove 50 when they are forced radially outward by the housing 90 on retrieving assembly 10—a condition that reliably exists only when retrieving assembly 10 is substantially adjacent to positioning assembly 12 (FIG. 1). Contrariwise, the latch dogs 68 retract radially inward into the positioning assembly 12 for disengagement from the annular groove 50 when the retrieving assembly 10 is extended to a spaced-apart relation away from the positioning assembly 12, in order to accommodate the retraction of latch dog heads 80 therebetween (FIG. 2).

In the event the retrieval assembly 10 creeps away from positioning assembly 12 without the operator's knowledge, the engagement of the top shoulder 85 of slide tube 83 with check shoulder 51 in housing 90 causes the slide tube also to move upward within positioning assembly 12. Continued upward movement of slide tube 83 causes the apertures 59 in the tube to move upward in relation to the positioning assembly 12, increasingly out of alignment with the entry ports 23 in elongate body 58. Before retrieval assembly 10 moves to an extended position sufficiently spaced from the positioning assembly 10 to permit latching dogs 68 to disengage from the annular groove 50, the apertures 59 move completely out of alignment with the entry ports 23, and flow through the ports is prevented and obstructed by the wall of the tube 83. Consequently, drilling fluid no longer flows past the latch assembly, and the abrupt increase in fluid pressure "above" the latch assembly warns of the incipient disengagement and allows the crew to cease drilling and initiate remedial measures.

It should also be noted that the alignment or non-alignment of the tube apertures 59 with the corresponding ports 23 in positioning assembly 12 play an advantageous role in signalling when the latch assembly has contacted the landing ring, as discussed. So long as the latching assembly is moving along the drill string with the two assemblies 10, 12 spaced apart as in FIG. 2, slide tube 83 is partially withdrawn up out of the positioning assembly 12 so that apertures 59 in the slide tube 83 do not align with the ports 23, and flow through the ports 23 is obstructed. Only when positioning assembly 12 contacts and is held against the landing ring, allowing retrieving assembly 10 to move down to its adjacent position, do apertures 59 and ports 23 align as shown in FIG. 3, opening the ports to allow fluid pressure to bear directly upon the piston tail 127. Thus, the check valve assembly 97 cannot be pushed by fluid pressure to uncock the slide tube assembly 15 to permit free flow of fluid, until the latch assembly is in the locked condition with latch dogs 68 pushed out into groove 50 by housing 90.

When drilling is ceased, a retrieval tool lowered down the drill string grasps the retrieval point 102, allowing the retrieval tool to be winched from the hole to pull the latch assembly, core barrel and core sample, etc., to the surface. In "up hole" rigs, the latch assembly gradually is lowered by gravity as the crew slowly bleeds drilling fluid from inside the drill string at the bottom end of the hole. Pulling upon the retrieval cable pulls the retrieval assembly 10 away from the positioning assembly 12, that is, from the position shown in FIG. 1 to the position shown in FIG. 2. With the separation of retrieval assembly 10, the beveled edges of the heads 80 of the latch dogs 68 are so inclined that further pulling on the retrieval cable causes the latch dogs 68 to move radially inwardly, away from the annular groove 50, to permit the entire latching assembly to be pulled or lowered to the earth's surface. If needed, the retrieval point can be pulled to cause plunger head 73 to hit the stop shoulder 75 in the housing 90, so that the slide tube 83 is pulled far enough upward in the positioning assembly 12 that the lowest end of the tube clears the ports 23. This allows for a break in any vacuum created in the drill string by the movement of the latch assembly.

It should be appreciated by one skilled in the art that the check valve assembly 97 is an optional feature of the invention, and that advantages of the invention may be realized in an apparatus incorporating only the hollow slide tube 83, as described herein, to regulate the flow of drilling fluid through the ports 23 in the body 58. Indeed, the check valve assembly 93 feature is most useful in shallow down hole, and up hole rigs, in the absence of the enormous static water pressures extant at the bottom of deep down hole rigs. Excessive static pressures associated with the column of water within a deep down hole rig can seriously interfere with the performance of the check valve assembly 97 aspect of the invention.

Although particular embodiments of the present invention have been described and illustrated herein, it should be recognized that modifications and variations may readily occur to those skilled in the art and that such modifications and variations may be made without departing from the scope of our invention. Consequently, our invention as claimed below may be practiced otherwise than is specifically described above.

We claim:

1. In a core barrel latch assembly for use in a drill string by a crew at the earth's surface, the improvement comprising means for providing an indication to the drilling crew whether the latch assembly is locked in a desired position within the drill string.

2. An apparatus according to claim 1, wherein said indication means comprises means for selectively substantially stopping the flow of a drilling fluid past the latch assembly.

3. A latching apparatus, movable in a subsurface drill string, for releasably securing a core barrel within the string, said drilling string including a latch coupling member having a recess therein, and said latching apparatus including an elongate body mounting thereon a movable latch engageable into the recess, and wherein drilling fluid flows into the latch coupling to induce fluid pressure therein, said latching apparatus comprising:

means for urging the latch into engagement with the recess;

seal means for preventing discharge of drilling fluid between the latching apparatus and the latch coupling member;

passage means, defined by the elongate body, for allowing drilling fluid to flow through said elongate body; and means, operably connected to said means for urging, for closing said passage means when the latch is disengaged from the recess.

* * * * *